US009239163B2

(12) United States Patent
Barry

(10) Patent No.: US 9,239,163 B2
(45) Date of Patent: Jan. 19, 2016

(54) BACKLIGHT TILE SYSTEM

(71) Applicant: Matthew Alan Barry, Spokane Valley, WA (US)

(72) Inventor: Matthew Alan Barry, Spokane Valley, WA (US)

( * ) Notice: Subject to any disclaimer, the term of this patent is extended or adjusted under 35 U.S.C. 154(b) by 0 days.

(21) Appl. No.: 14/310,168

(22) Filed: Jun. 20, 2014

(65) Prior Publication Data

US 2014/0376214 A1 Dec. 25, 2014

Related U.S. Application Data

(60) Provisional application No. 61/837,831, filed on Jun. 21, 2013.

(51) Int. Cl.

| | |
|---|---|
| ***F21V 33/00*** | (2006.01) |
| ***E04F 19/02*** | (2006.01) |
| ***E04F 13/08*** | (2006.01) |
| *F21V 17/10* | (2006.01) |
| *F21Y 101/02* | (2006.01) |

(52) U.S. Cl.

CPC ..... *F21V 33/006* (2013.01); *E04F 13/0862* (2013.01); *E04F 19/02* (2013.01); *F21V 17/105* (2013.01); *F21Y 2101/02* (2013.01); *Y10T 29/49117* (2015.01)

(58) Field of Classification Search

CPC .... F21V 33/006; F21V 17/105; E04F 19/022; E04F 21/18; F21Y 2103/00

USPC ..... 362/147

See application file for complete search history.

(56) References Cited

U.S. PATENT DOCUMENTS

| | | | | |
|---|---|---|---|---|
| 7,578,596 | B2 * | 8/2009 | Martin | 362/101 |
| 8,061,865 | B2 * | 11/2011 | Piepgras et al. | 362/149 |
| 8,444,287 | B2 * | 5/2013 | Hardesty | 362/153 |
| 2005/0060949 | A1 * | 3/2005 | McNaught | F21S 8/02 52/28 |
| 2005/0257436 | A1 * | 11/2005 | Vanderpol | 52/28 |
| 2006/0256550 | A1 * | 11/2006 | Schultz | 362/147 |
| 2007/0103902 | A1 * | 5/2007 | Hsiao | E04F 13/0871 362/240 |
| 2009/0086503 | A1 * | 4/2009 | Trujillo | 362/605 |
| 2010/0284173 | A1 * | 11/2010 | Verjans et al. | 362/145 |
| 2011/0242800 | A1 * | 10/2011 | Borghetto | E04F 13/0885 362/147 |
| 2012/0176776 | A1 * | 7/2012 | Van Herpen et al. | 362/147 |
| 2014/0070724 | A1 * | 3/2014 | Gould | F21V 13/02 315/291 |
| 2014/0085873 | A1 * | 3/2014 | Willis | F21V 17/101 362/145 |

FOREIGN PATENT DOCUMENTS

CN 202215995 * 5/2010

OTHER PUBLICATIONS

Espacenet—Translation CN202215995 (U)—May 9, 2012 Novel energy-saving waterproof light-emitting diode (LED) lamp.*

* cited by examiner

*Primary Examiner* — Andrew Coughlin

(57) ABSTRACT

A backlight tile system is configured to be attached to a wall stud and to be surrounded by tile attached to drywall. The backlight tile system has a rear channel that is mechanically coupled to the wall stud and extending through the drywall. A first lighting strip is detachably coupled to the rear channel with a first adhesive strip. A front channel is detachably coupled to the rear channel with a first magnetic strip. A mosaic tile is directly attached to the front channel. The first lighting strip is configured to render light through the mosaic tile.

9 Claims, 4 Drawing Sheets

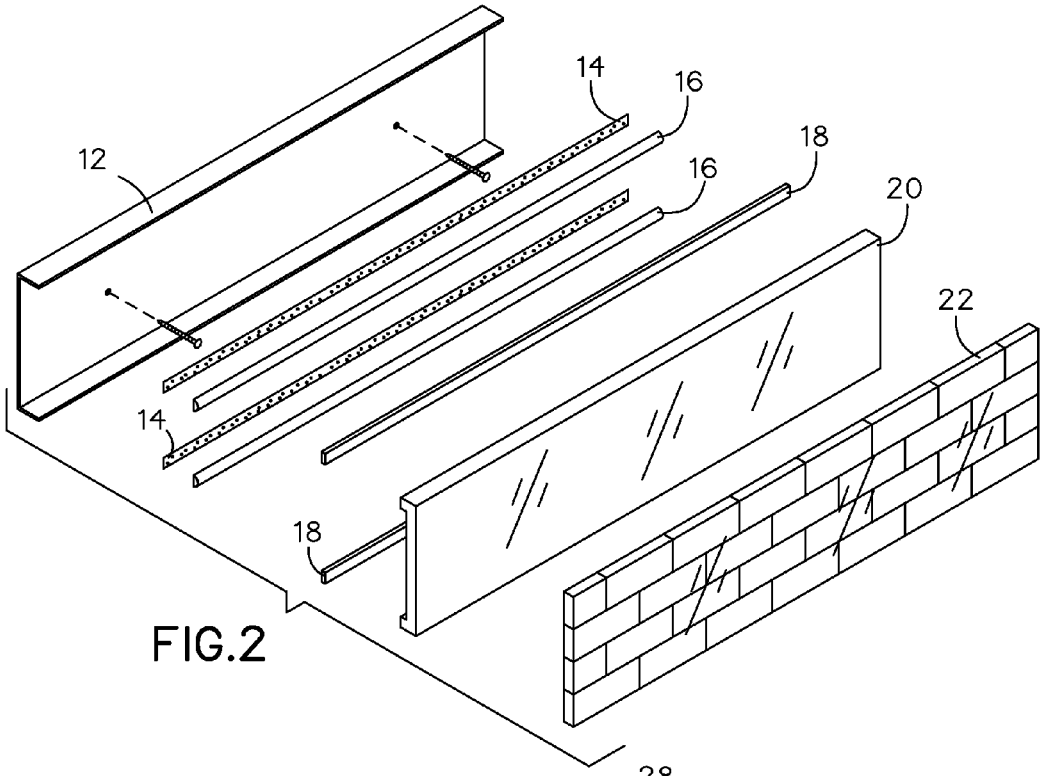
FIG.2
FIG.3
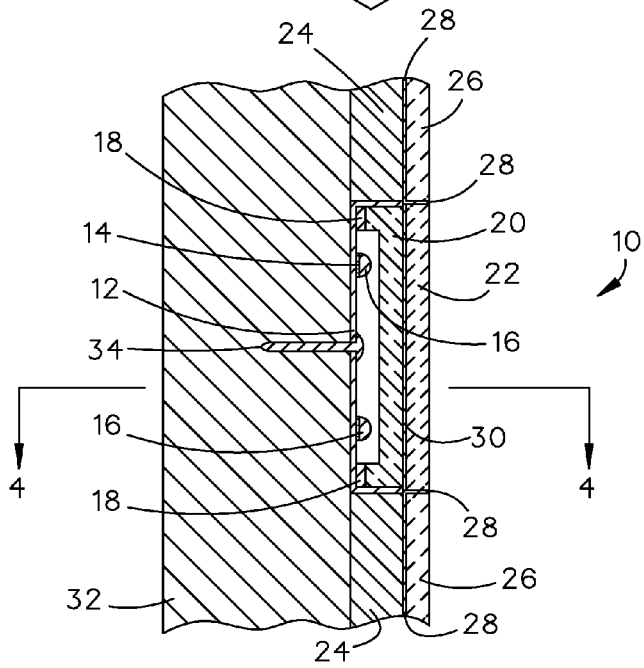

BACKLIGHT TILE SYSTEM

RELATED APPLICATION

This application claims priority to provisional patent application U.S. Ser. No. 61/837,831 filed on Jun. 21, 2013, the entire contents of which is herein incorporated by reference.

BACKGROUND

The embodiments herein relate generally to home construction.

Prior to embodiments of the disclosed invention, users sought new ways to illuminate kitchen or bathroom areas, without having to constantly change bulbs, or fixtures. Prior art LED tile solutions have difficult processes on how to install tile to be backlit, or by installing LEDs in the grout lines it's difficult to access the LEDs when they burn out. Embodiments of the present invention solve this problem.

SUMMARY

A backlight tile system is configured to be attached to a wall stud and to be surrounded by tile attached to drywall. The backlight tile system has a rear channel that is mechanically coupled to the wall stud and extending through the drywall. A first lighting strip is detachably coupled to the rear channel with a first adhesive strip. A front channel is detachably coupled to the rear channel with a first magnetic strip. A mosaic tile is directly attached to the front channel. The first lighting strip is configured to render light through the mosaic tile.

In some embodiments, a second lighting strip can be detachably coupled to the rear channel with a second adhesive strip. The second lighting strip is configured to render additional light through the mosaic tile.

In some embodiments, the first lighting strip and the second lighting strip can be an IP65 waterproof light emitting diode lighting strip. This is configured to provide light while being impervious to moisture.

In some embodiments, the rear channel can be made from ½ inch 18 gauge galvanized steel channel that is configured to retain fire within the rear channel, preventing the fire from spreading to the wall stud or the drywall.

A process for installing a backlight tile system into a wall stud and to be surrounded by tile attached to drywall includes the following steps, which are not necessarily in order. First, mounting a rear channel to the wall stud with at least one screw. Next, adhering a lighting strip to the rear channel. After that, adhering a mosaic tile to a front channel. Then, connecting the lighting strip to a power source with wiring and a switch. Following that, connecting the front channel to the rear channel with at least one magnetic strip. Next, joining the mosaic tile to the tile with grout.

In some embodiments the process can further include switching the power source on and testing the lighting strip. Next, removing the grout between the mosaic tile and the tile. Then, disconnecting the front channel from the rear channel thus providing access to the lighting strip. Finally, replacing the lighting strip with another lighting strip.

BRIEF DESCRIPTION OF THE FIGURES

The detailed description of some embodiments of an embodiment of the invention is made below with reference to the accompanying figures, wherein like numerals represent corresponding parts of the figures.

FIG. 2 is an exploded view of an embodiment of the invention.

FIG. 3 is a section view of an embodiment of the invention, taken along line 3-3 in FIG. 1.

DETAILED DESCRIPTION OF CERTAIN EMBODIMENTS

Figure 1:
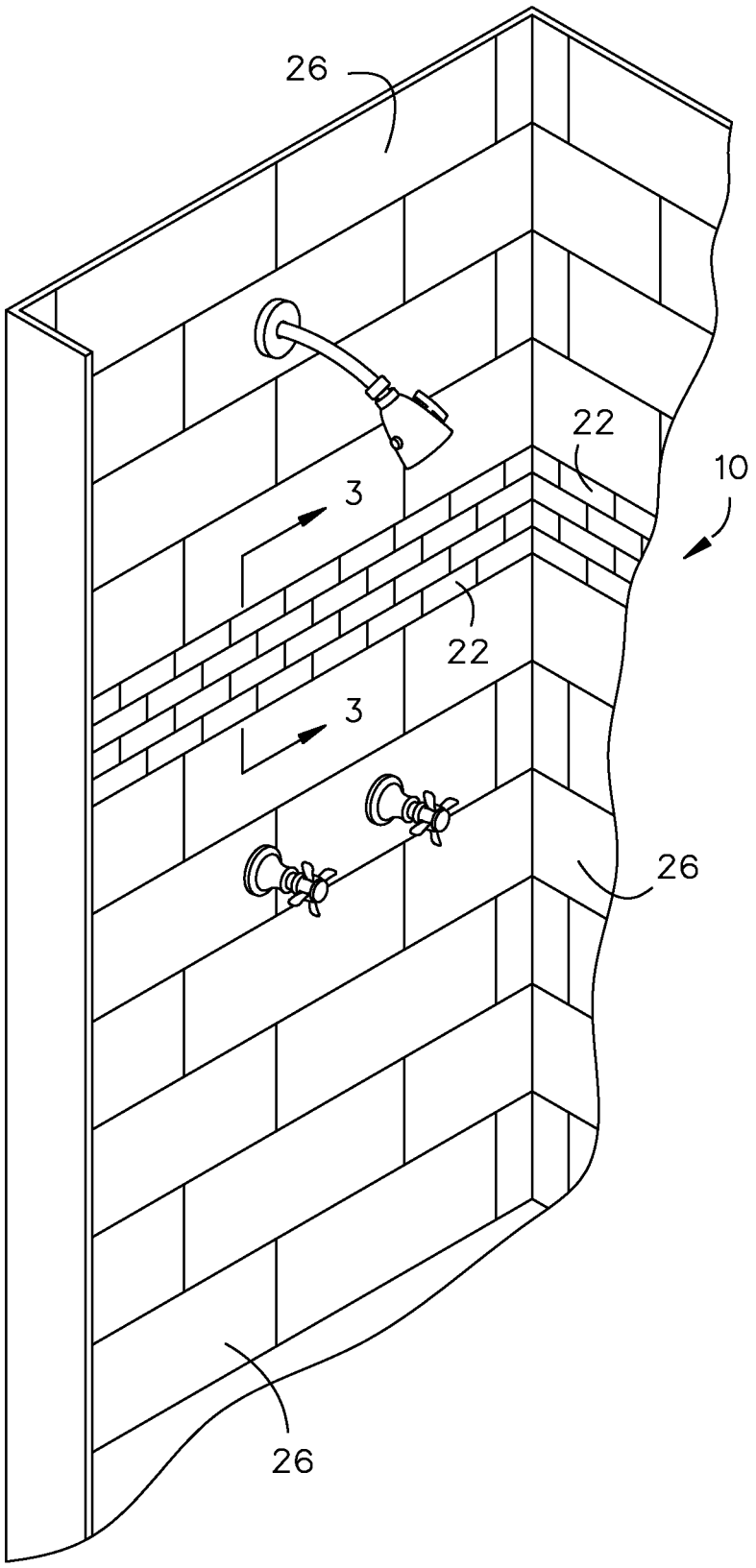
FIG. 1 is a perspective view of an embodiment of the invention.
Figure 4:
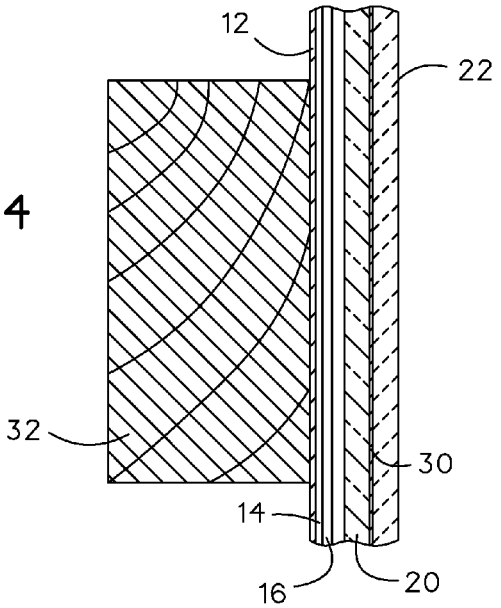
FIG. 4 is a section view of an embodiment of the invention, taken along line 4-4 in FIG. 3.
Figure 5:
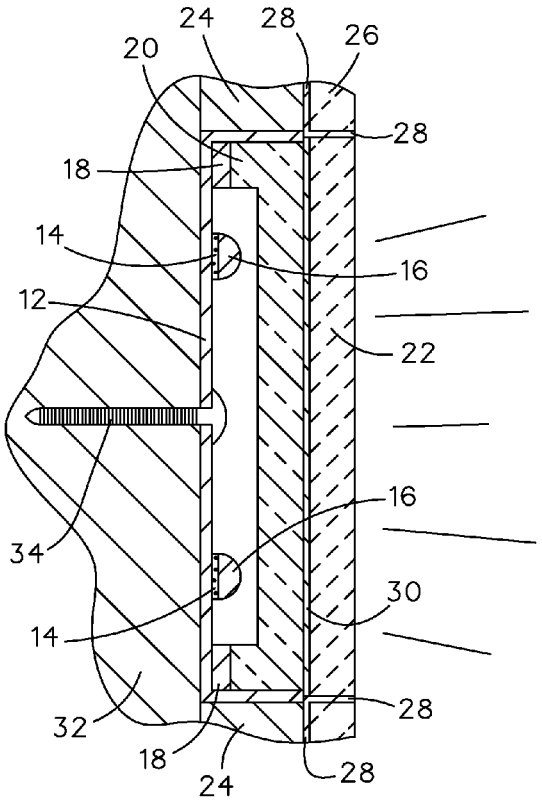
FIG. 5 is a detailed section of an embodiment of the invention.
Figure 6:
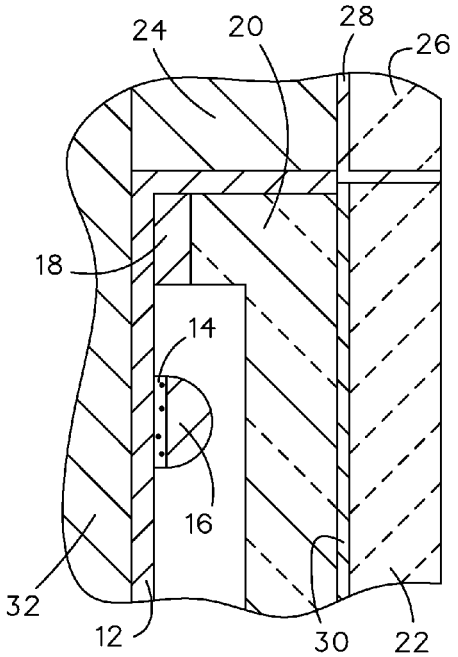
FIG. 6 is a detailed section of an embodiment of the invention.

By way of example, and referring to FIG. 1, a user desires to use backlight lighting in a wet area such as a shower (as shown) or perhaps the backsplash of a kitchen or anywhere else. One embodiment of backlight tile system 10 accomplishes this function by having tile 26 embedded around mosaic tile 22.

As shown in FIG. 2, backlight tile system 10 comprises rear channel 12 detachably coupled to first lighting strip 16 with first adhesive strip 14. Likewise, rear channel 12 is detachably coupled to second lighting strip 16 with second adhesive strip 14. Rear channel 12 is mechanically coupled to front channel 20 is first magnetic strip 18 and second magnetic strip 18. Mosaic tile 22 is directly attached to front channel 20 as shown in more detail below.

In some exemplary embodiments. Rear channel 12 can be a ½ inch 18 gauge galvanized steel channel, having magnetic properties, but being generally impervious to moisture. First lighting strip 16 and second lighting strip 16 can each be an IP65 waterproof light emitting diode (LED) lighting strip. Front channel 20 can be a clear acrylic channel. The acrylic channel provides an advantage of keeping moisture away from lighting strip 16, while also enabling lighting strip 16 to dissipate heat, thus preventing a fire. If a fire were to occur, due to some error in installation or a poor choice of lighting strip 16, by using ½ inch 18 gauge galvanized steel, the fire will be contained to rear channel 16 and will not spread to wall stud 32 or to drywall 26.

Turning to FIG. 3, FIG. 4, FIG. 5 and FIG. 6, wall stud 32 is frequently covered with drywall 26. Tile 26 can be mechanically coupled to drywall 26 with grout 28. Tile 26 can also be mechanically coupled to other tile 26 with grout 28. Here, tile 26 is partially hollowed to accommodate backlight tile system 10. Rear channel 12 is mechanically coupled to wall stud 32 with at least one screw 34. Mosaic tile 22 is mechanically coupled to front channel 20 with grout 28. Likewise, mosaic tile 22 is mechanically coupled to tile 26 with grout 28.

Figure 7:
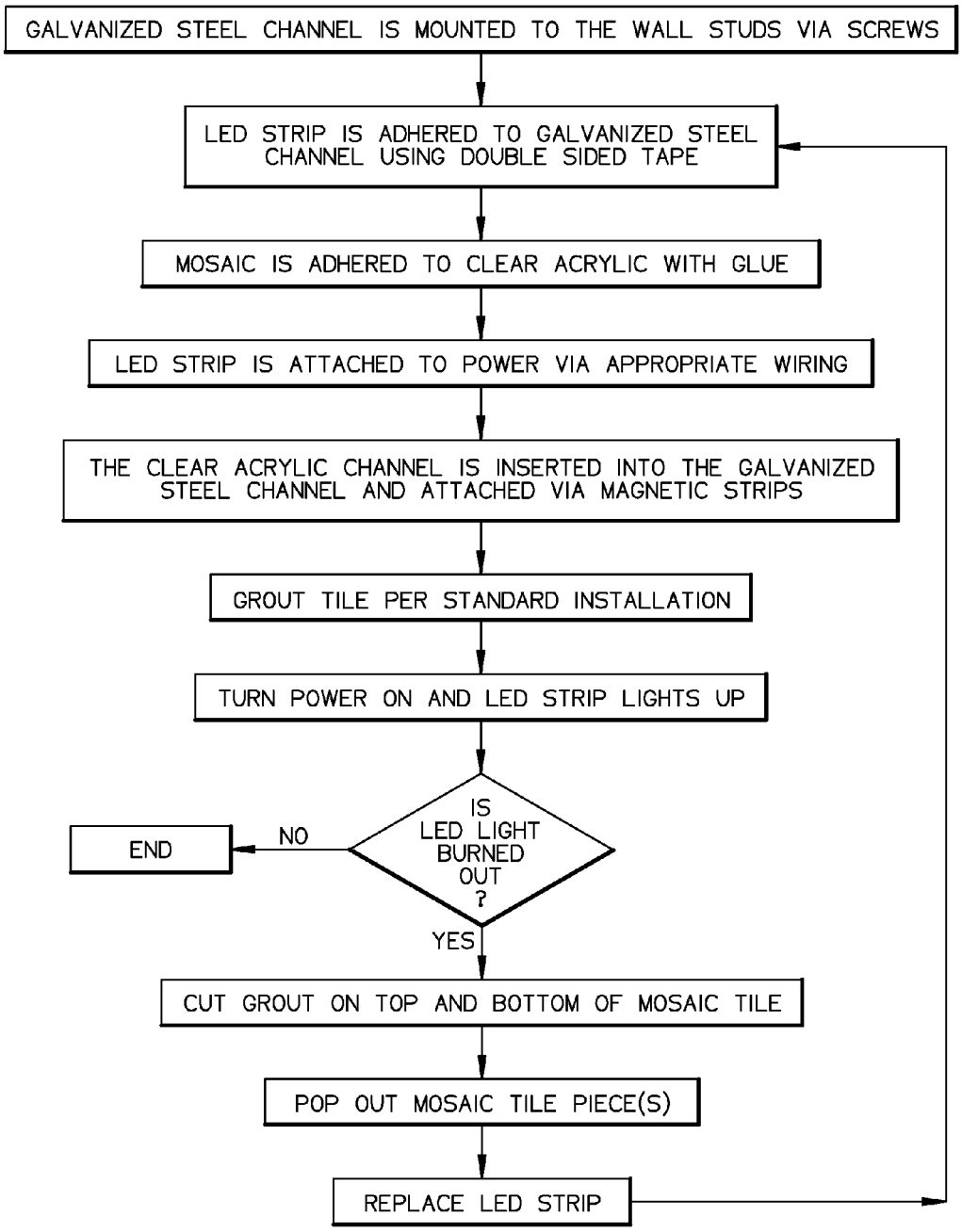
FIG. 7 is a flow chart of how to install the invention.

FIG. 7 provides a process for installing the invention, though these steps may not be in order. First, mounting rear channel 12 to wall stud 32 with at least one screw 34. Next, adhering lighting strip 16 to rear channel 12 with adhesive 16. After that, adhering mosaic tile 22 to front channel 20 with an adhesive, such as glue 30. Following that, connecting lighting strip 16 to a power source with wiring and a switch. Then, connecting front channel 20 to the rear channel 12 with at least one magnetic strip 18.

Next, joining mosaic tile 22 to tile 26 with grout 28. After that switching the power source on and testing lighting strip 16. After that, if lighting strip 16 is burned out, removing grout 28 between mosaic tile 22 and tile 26. Following that, disconnecting front channel 20 from rear channel 12 thus providing access to lighting strip 16. Finally, replacing lighting strip 16 with another lighting strip 16.

Persons of ordinary skill in the art may appreciate that numerous design configurations may be possible to enjoy the functional benefits of the inventive systems. Thus, given the wide variety of configurations and arrangements of embodiments of the present invention the scope of an embodiment of the invention is reflected by the breadth of the claims below rather than narrowed by the embodiments described above.

What is claimed is:

1. A backlight tile system, configured to be attached to a wall stud and to be surrounded by tile attached to drywall; the backlight tile system comprising:

a rear channel, mechanically coupled to the wall stud and extending through the drywall;

a first lighting strip, detachably coupled to the rear channel with a first adhesive strip;

a front channel, detachably coupled to the rear channel with a first magnetic strip; and a mosaic tile, directly attached to the front channel;

wherein the first lighting strip is configured to render light through the mosaic tile, and wherein the mosaic tile attached to the front channel is substantially flush with the tile when the front channel is coupled to the rear channel.

2. The backlight tile system of claim 1, further comprising a second lighting strip, detachably coupled to the rear channel with a second adhesive strip; wherein the second lighting strip is configured to render additional light through the mosaic tile.

3. The backlight tile system of claim 2, wherein the first lighting strip and the second lighting strip are an IP65 waterproof light emitting diode lighting strip configured to provide light while being impervious to moisture.

4. The backlight tile system of claim 1, wherein the rear channel is made from ½ inch 18 gauge galvanized steel channel that is configured to retain fire within the rear channel, preventing the fire from spreading to the wall stud or the drywall.

5. A process for installing a backlight tile system into a wall stud and to be surrounded by tile attached to drywall; the process comprising:

mounting a rear channel to the wall stud with at least one screw;

adhering a lighting strip to the rear channel; adhering a mosaic tile to a front channel;

connecting the lighting strip to a power source with wiring and a switch;

connecting the front channel to the rear channel with at least one magnetic strip; and joining the mosaic tile to the tile with grout such that the mosaic tile and the tile are substantially flush with one another.

6. The process of claim 5, further comprising: switching the power source on and testing the lighting strip.

7. The process of claim 6, further comprising: removing the grout between the mosaic tile and the tile.

8. The process of claim 7, further comprising: disconnecting the front channel from the rear channel thus providing access to the lighting strip.

9. The process of claim 8, further comprising: replacing the lighting strip with another lighting strip.

* * * * *